US011466924B2

(12) United States Patent
Song

(10) Patent No.: US 11,466,924 B2
(45) Date of Patent: Oct. 11, 2022

(54) REFRIGERATOR

(71) Applicant: LG ELECTRONICS INC., Seoul (KR)

(72) Inventor: Minho Song, Seoul (KR)

(73) Assignee: LG Electronics, Inc., Seoul (KR)

( * ) Notice: Subject to any disclaimer, the term of this patent is extended or adjusted under 35 U.S.C. 154(b) by 41 days.

(21) Appl. No.: 16/414,252

(22) Filed: May 16, 2019

(65) Prior Publication Data

US 2019/0368801 A1 Dec. 5, 2019

(30) Foreign Application Priority Data

Jun. 4, 2018 (KR) ..... 10-2018-0064357

(51) Int. Cl.
*F25D 17/08* (2006.01)
*F25D 17/04* (2006.01)
*F25D 17/06* (2006.01)

(52) U.S. Cl.
CPC ..... *F25D 17/08* (2013.01); *F25D 17/045* (2013.01); *F25D 17/062* (2013.01); *F25D 2317/063* (2013.01); *F25D 2317/0654* (2013.01); *F25D 2317/0671* (2013.01); *F25D 2317/0672* (2013.01)

(58) Field of Classification Search
CPC ..... F25D 17/08; F25D 14/045; F25D 17/062; F25D 17/045; F25D 2317/063; F25D 2317/0654; F25D 2317/0671; F25D 2317/0672
See application file for complete search history.

(56) References Cited

U.S. PATENT DOCUMENTS 5,979,174 A * 11/1999 Kim ..... F25D 17/065 62/404
5,992,164 A * 11/1999 Kim ..... F25D 17/045 62/186

(Continued)

FOREIGN PATENT DOCUMENTS

KR 100162411 2/1999
KR 10-2010-0122155 11/2010

(Continued)

OTHER PUBLICATIONS

Office Action in Korean Appln. No. 10-2018-0064357, dated Jul. 15, 2022, 17 pages (with English translation).

*Primary Examiner* — Cassey D Bauer
(74) *Attorney, Agent, or Firm* — Fish & Richardson P.C.

(57) ABSTRACT

A refrigerator includes an inner case defining a storage chamber, a door disposed at a front portion of the inner case and defining a storage space therein, a cool air distribution device disposed inside the inner case and defining a box inlet portion configured to receive cool air, a multi-duct disposed in the inner case and defining discharge holes configured to discharge a first portion of cool air in the cool air distribution device to the storage chamber, and a duct assembly that extends from the cool air distribution device toward the door and that is configured to carry a second portion of cool air in the cool air distribution device. The inner case defines a case inlet at the front portion of the inner case, and the case inlet is configured to communicate with the duct assembly and supply the second portion of cool air to the storage chamber.

20 Claims, 13 Drawing Sheets

(56) References Cited

U.S. PATENT DOCUMENTS

| | | | | |
|---|---|---|---|---|
| 6,381,982 | B1 * | 5/2002 | Kim | F25D 17/065 62/407 |
| 2014/0273795 | A1 * | 9/2014 | Koppenhaver | F25D 11/02 454/251 |

FOREIGN PATENT DOCUMENTS

| | | |
|---|---|---|
| KR | 20110098413 | 9/2011 |
| KR | 20180035622 | 4/2018 |

* cited by examiner

REFRIGERATOR

CROSS-REFERENCE TO RELATED APPLICATION(S)

This application claims priority under 35 U.S.C. § 119 to Korean Application No. 10-2018-0064357, filed on Jun. 4, 2018, entire disclosures of which are hereby incorporated by reference.

TECHNICAL FIELD

The present disclosure relates to a refrigerator.

BACKGROUND

A refrigerator may include a storage chamber and a door that defines a separate storage space. In some cases, the refrigerator may be designed to increase the size of the refrigerator in which the depth of the storage chamber may become deeper and the separate storage space may be disposed at a back surface of the door.

In some examples, the refrigerator may include a door that is configured to open and close the storage chamber in the refrigerator and that includes an inner door and an outer door. In some cases, the inner door may include a basket that defines a storage space (hereinafter, door-side storage space) and that is mounted on a back surface of the inner door which is closely attached to a cabinet. In some cases, the inner door may define an opening portion which is accessible to an inside of the basket, and the opening portion may be covered by the outer door.

In some examples, the user may store food items, which are frequently taken out and stored, in the basket, and take out the food items stored in the basket by opening only the outer door, which may reduce an outflow of cool air from the storage chamber in the refrigerator to the outside.

In some cases, the cool air in the storage chamber may not be sufficiently supplied to the door-side storage chamber, which makes it difficult to maintain the low-temperature environment in the door-side storage chamber.

For example, in a case where an evaporator for generating cool air to be supplied to the storage chamber is installed at the rear side of the rear wall of the storage chamber, and a discharge port for supplying cool air to the storage chamber is defined at the rear wall of the storage chamber, the cool air may not be sufficiently transmitted to the door-side storage space since the door-side storage space is disposed in a door relatively far from the rear wall.

In some cases, a gasket structure may be disposed in the periphery of the door to improve sealing of the door including the inner door and the outer door. However, the gasket structure may restrict the cool air in the storage chamber from being sufficiently transmitted to the door-side storage space.

In some cases, the food items stored in the door-side storage space may be an obstacle for circulating of the cool air supplied into the basket, which may cause an internal temperature of the door-side storage space to be higher than an internal temperature of the storage chamber.

SUMMARY

The present disclosure describes a refrigerator configured to maintain a low-temperature environment in a door-side storage space for improving the freshness of food stored in a door side.

In particular, the present disclosure describes a refrigerator which is capable of generating a cold air flow which flows to a door side so that the door-side storage space may maintain a low-temperature environment.

The present disclosure also describes a refrigerator which may appropriately distribute cool air supplied to a storage chamber and cool air supplied to a door-side storage space.

According to one aspect of the subject matter described in this application, a refrigerator includes: an inner case that defines a storage chamber; a door that is disposed at a front portion of the inner case and that defines a storage space therein; a cool air distribution device that is disposed inside the inner case and that defines a box inlet portion configured to receive cool air; a multi-duct that is disposed in the inner case and that defines a plurality of discharge holes configured to discharge a first portion of cool air in the cool air distribution device to the storage chamber; and a duct assembly that is coupled to the cool air distribution device, that extends toward the door, and that is configured to carry a second portion of cool air in the cool air distribution device. The inner case defines a case inlet that is disposed at the front portion of the inner case, that is configured to communicate with the duct assembly, and that is configured to supply the second portion of cool air to the storage chamber.

Implementations according to this aspect may include one or more of the following features. For example, the multi-duct may be disposed at a rear wall of the inner case, and the cool air distribution device may include a control box disposed between the rear wall of the inner case and the multi-duct. In some examples, the storage chamber may include a freezing chamber and a refrigerating chamber that are disposed in a lateral direction, and the refrigerator may further include a barrier that defines a connection flow path between the freezing chamber and the refrigerating chamber. In some examples, the box inlet portion may face the barrier and be configured to communicate with the connection flow path and to receive cool air in the freezing chamber.

In some implementations, the cool air distribution device may include a box main body that defines a cool air flow path, and a divider that is disposed inside the box main body and that partitions the cool air flow path. In some examples, the divider may extend vertically at an inside of the box main body and partition the cool air flow path into a first flow path and a second flow path. In some examples, the plurality of discharge holes of the multi-duct may include a first discharge hole configured to communicate with the first flow path, and a second discharge hole configured to communicate with the second flow path.

In some implementations, the first flow path may be disposed between the inner case and the multi-duct, and the second flow path may be disposed between the divider and a front portion of the box main body. In some examples, the box main body may define a box discharge port configured to communicate with the second flow path and to supply cool air to the duct assembly.

In some implementations, the duct assembly may be disposed at an upper side of the inner case. In some examples, the duct assembly may include: a duct portion that is coupled to an upper surface of the cool air distribution device and that extends toward the door; and a case connection portion disposed at a front portion of the duct portion and coupled to the inner case. In some examples, the case connection portion of the duct assembly may cover the case inlet. In some examples, the inner case may further include a recessed portion recessed upwardly from an inner upper surface of the inner case, where the case inlet is defined in the recessed portion.

In some implementations, the refrigerator may further include a discharge grill coupled to the recessed portion and configured to discharge cool air toward the storage space of the door. In some implementations, the duct portion may include a duct support that is disposed inside the duct portion and that extends upward from a lower surface of the duct portion to an upper surface of the duct portion.

According to another aspect, a refrigerator includes: an inner case that defines a refrigerating chamber and a freezing chamber; a barrier that divides the refrigerating chamber and the freezing chamber; a connection flow path disposed at the barrier and configured to supply cool air from the freezing chamber to the refrigerating chamber; a control box disposed at an upper portion of the inner case and configured to receive cool air from the connection flow path; a multi-duct that is configured to communicate with the control box and that defines a plurality of discharge holes configured to discharge a first portion of cool air in the control box to the refrigerating chamber; and a duct assembly that is coupled to the control box, that extends forward, and that is configured to carry a second portion of cool air in the control box. The inner case defines a case inlet that is disposed at a front portion of the inner case, that is configured to communicate with the duct assembly, and that is configured to supply the second portion of cool air to the refrigerating chamber.

Implementations according to this aspect may include one or more of the following features. For example, the refrigerator may further include a door that is disposed at the front portion of the inner case and that defines a storage space therein, where the case inlet is disposed vertically above the storage space. In some examples, the duct assembly may be disposed at an upper wall of the inner case.

In some implementations, the control box further may include: a box main body that defines a cool air flow path; and a divider that is disposed inside the box main body and that partitions the cool air flow path into a first flow path and a second flow path. In some implementations, the duct assembly may include a duct portion that is coupled to an upper surface of the control box and that extends forward, and a case connection portion disposed at a front portion of the duct portion and coupled to the case inlet In some examples, cooling of the electric components may be facilitated since the cool air distribution device includes the control box.

In some examples, since the cool air may be supplied to the front side of the storage chamber through the duct, the door-side storage space may be maintained in a low-temperature environment, thereby being capable of improving the freshness of the food stored in the door.

In some examples, it may be possible to define a cool air flow to the door side without reducing the storage space of the storage chamber by installing a duct on the upper side of the inner case.

In some examples, by a distribution structure configured to distribute, at an inside of a control box, cool air supplied to the refrigerating chamber and cool air supplied to the door-side storage space, it may be possible to appropriately distribute the cool air to the refrigerating chamber and the door-side storage space.

DETAILED DESCRIPTION

Figure 1:
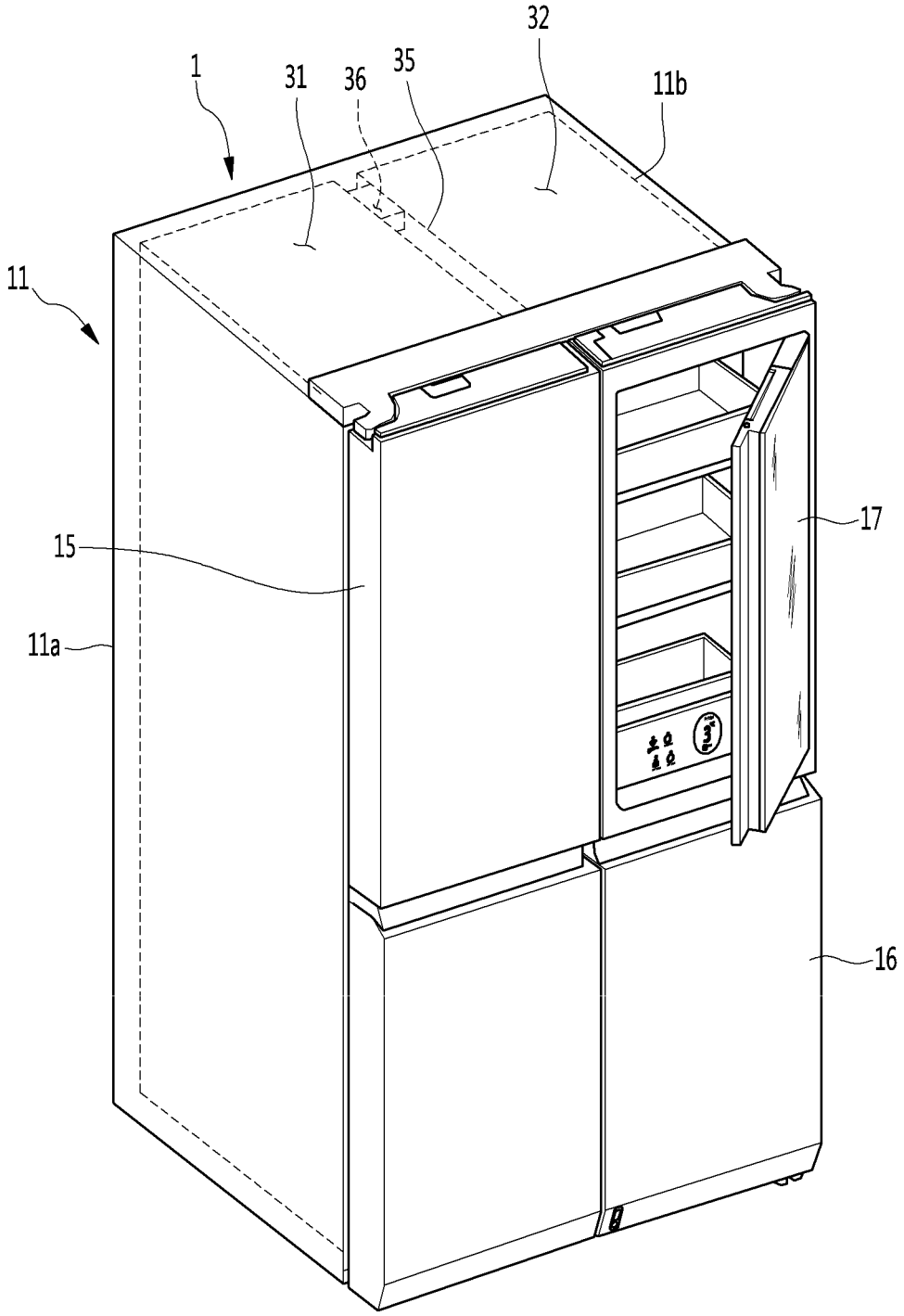
FIG. 1 is a perspective view illustrating a configuration of an example refrigerator.

Hereinafter, one or more implementations of the present disclosure will be described in detail with reference to exemplary drawings. It should be noted that, in adding reference numerals to the constituent elements of the drawings, the same constituent elements are denoted by the same reference numerals even though they are illustrated in different drawings.

Figure 2:
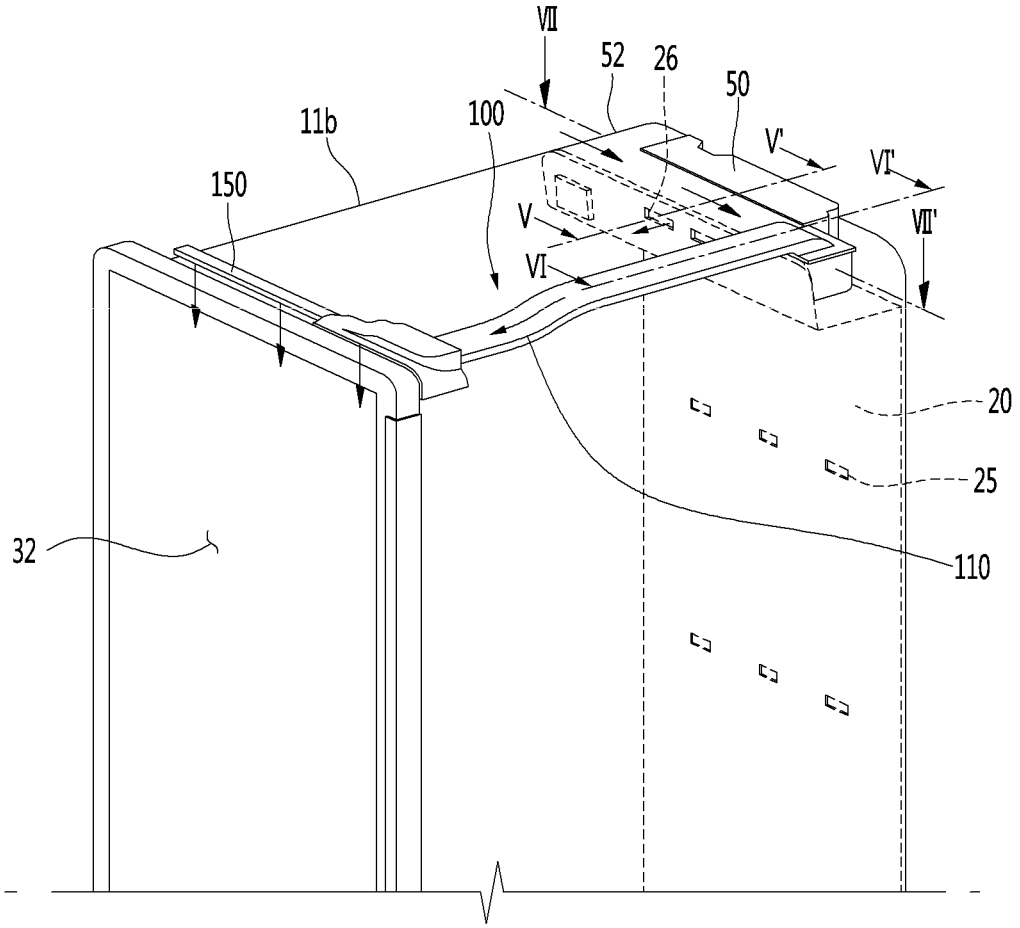
FIG. 2 is a view illustrating an example duct assembly and an example peripheral structure thereof.
Figure 3:
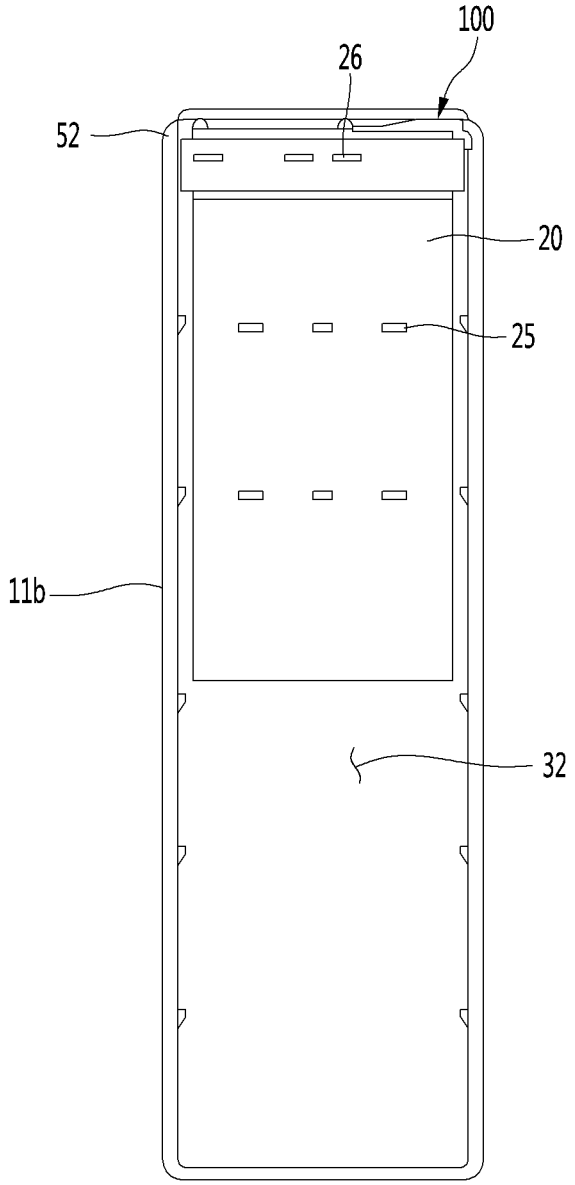
FIG. 3 is a front view illustrating an inner configuration and an outer configuration of an example refrigerating chamber inner case.

FIG. 1 is a perspective view illustrating a configuration of an example refrigerator, FIG. 2 is a view illustrating an example duct assembly and an example peripheral structure thereof, and FIG. 3 is a front view illustrating an inner and an outer configuration of an example refrigerating chamber inner case.

Referring to FIGS. 1 to 3, a refrigerator 1 may include a cabinet 11 that defines a storage chamber therein, and a door coupled to the cabinet 11 and configured to open and close the storage chamber.

The cabinet 11 may include an inner case 11*b* and an outer case 11*a*, and a heat insulating material may be disposed between the inner case 11*b* and the outer case 11*a*. The inner case 11*b* defines the freezing chamber and the refrigerating chamber. For example, the inner case 11*b* may include a freezing chamber inner case that defines a freezing chamber and a refrigerating chamber inner case that defines a freezing chamber. FIG. 2 illustrates an example of a refrigerating chamber inner case. The refrigerating chamber inner case may have the shape of a hexahedron whose front portion is opened.

The storage chamber may include a freezing chamber 31 and a refrigerating chamber 32, and the freezing chamber 31 and the refrigerating chamber 32 may store one or more objects to be stored such as food.

In some implementations, the freezing chamber 31 and the refrigerating chamber 32 may be partitioned the inside of the cabinet 11 by the barrier 35 in the lateral direction or in the vertical direction. In FIG. 3, the freezing chamber 31 and the refrigerating chamber 32 are partitioned by the barrier 35 in the lateral direction.

The door may include a freezing chamber door 15 configured to open and close the freezing chamber 31 and a refrigerating chamber door 16 configured to open and close the refrigerating chamber 32. The freezing chamber door 15 and the refrigerating chamber door 16 may be disposed in front of the inner case 11*b*.

A food storage space may be defined in at least one of the freezing chamber door 15 or the refrigerating chamber door 16. For example, the freezing chamber door 15 and the refrigerating chamber door 16 may include a basket in which food may be stored.

In some implementations, the refrigerating chamber door 16 may further include a sub door 17 that allows the object (e.g., food) stored in the refrigerating chamber door 16 to be taken out without opening the refrigerating chamber door 16.

The barrier 35 may include a connection flow path 36 that defines a cool air passage configured to supply cool air of the freezing chamber 31 to the refrigerating chamber 32.

In some implementations, the refrigerator 1 includes a control box 50 in which electric components are installed and which is configured to receive cool air from the connection flow path 36, and a duct assembly 100 which communicates with the control box 50 to supply cool air to a front portion of the refrigerating chamber 32, for example, toward the refrigerating chamber door 16. The control box 50 may be disposed on the inner ceiling side of the inner case 11*b*.

The control box 50 may include a box inlet portion 52 which communicates with the connection flow path 36 and into which the cool air passing through the connection flow path 36 flows.

The multi-duct 20 may be coupled to a rear wall of the inner case 11*b*, that is, a rear wall of the refrigerating chamber 32. Between the rear wall of the inner case 11*b* and the multi-duct 20, a first flow path 55*a* (see FIG. 5) through which at least a portion of the cool air flows among the cool air flowing into the control box 50 may be defined.

The multi-duct 20 may define a plurality of discharge holes 25 and 26 which discharges the cool air into the refrigerating chamber 32. The plurality of discharge holes 25 and 26 may include a first discharge hole 25 which is disposed on the rear wall side of the refrigerating chamber 32 and a second discharge hole 26 which is disposed on the front side of the control box 50.

A plurality of first discharge holes 25 may be disposed to be vertically spaced apart from each other, and a plurality of second discharge holes 26 may be disposed to be spaced apart from each other in the lateral direction.

Some of the cool air flowing through the control box 50 may be discharged to the upper and middle portions of the refrigerating chamber 32 through the first discharge hole 25 via the first flow path 55*a*. In addition, the other portion of the cool air may be discharged to the upper portion of the refrigerating chamber 32 through the second discharge hole 26.

The duct assembly 100 includes a main duct 110 coupled to the control box 50 to extend forward and a discharge grill 150 which is coupled to a front portion of the main duct 110 to extend in the lateral direction and discharges cool air toward the upper space of the refrigerating chamber door 16.

Figure 4:
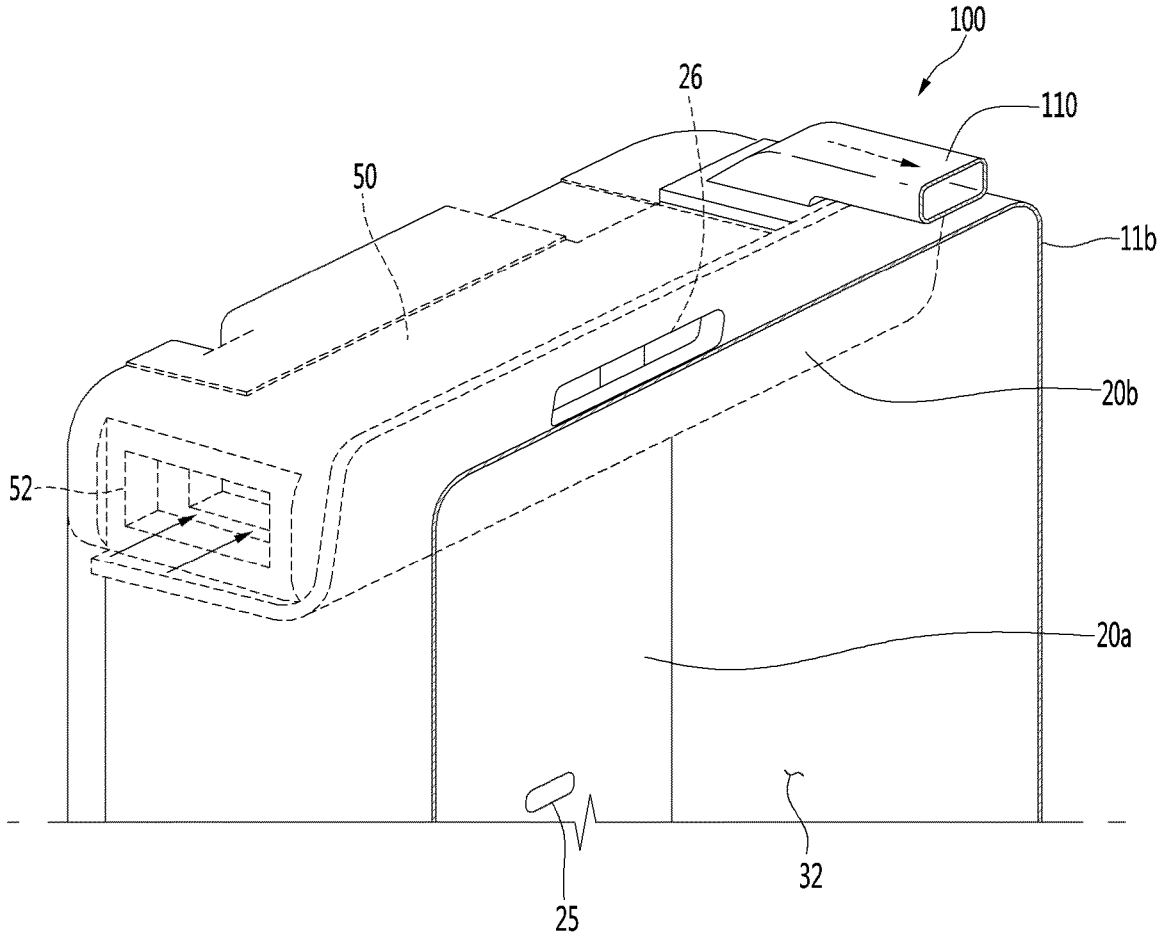
FIG. 4 is a view illustrating a configuration of an example control box and an example multi-duct.
Figure 5:
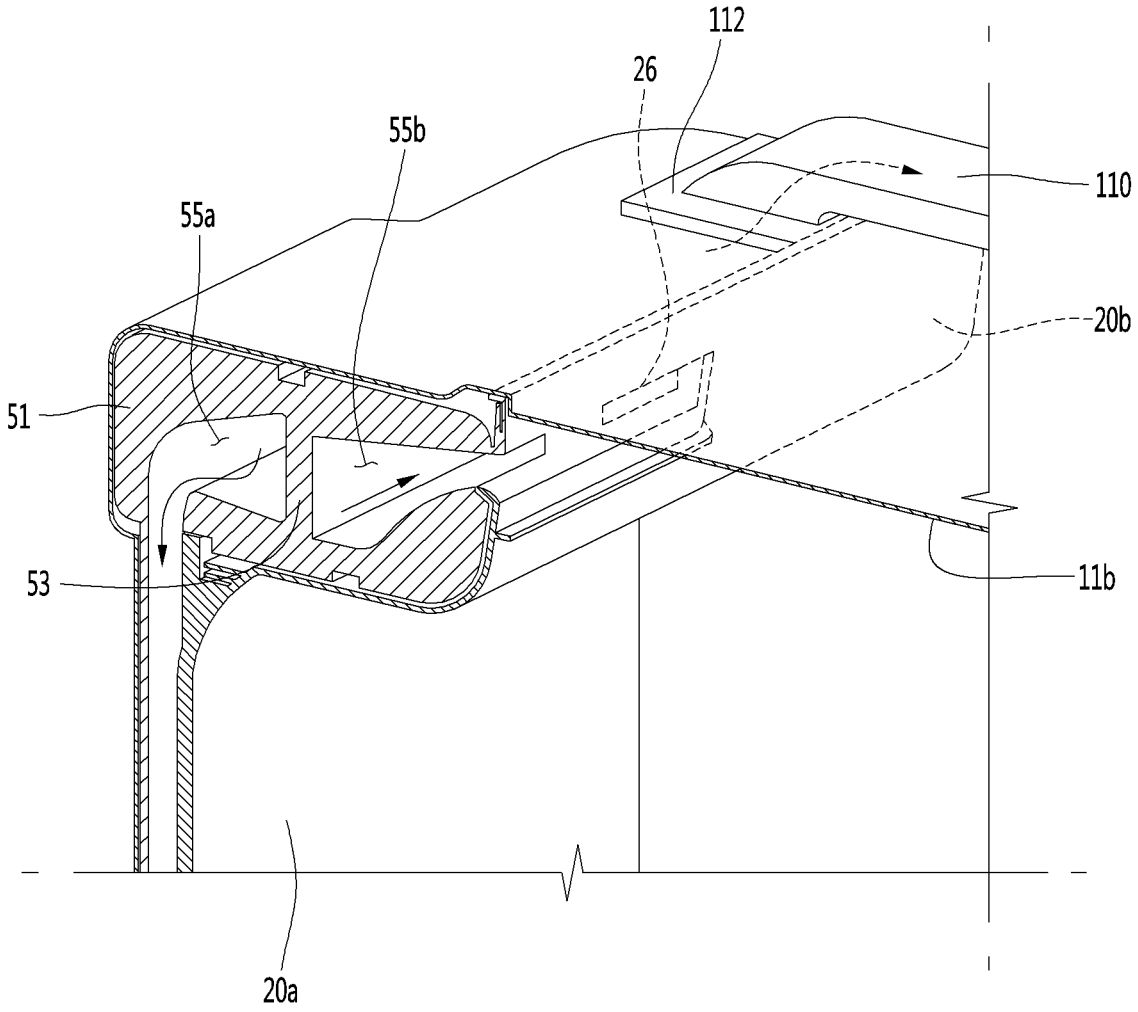
FIG. 5 is a sectional view taken along line V-V of FIG. 2.
Figure 6:
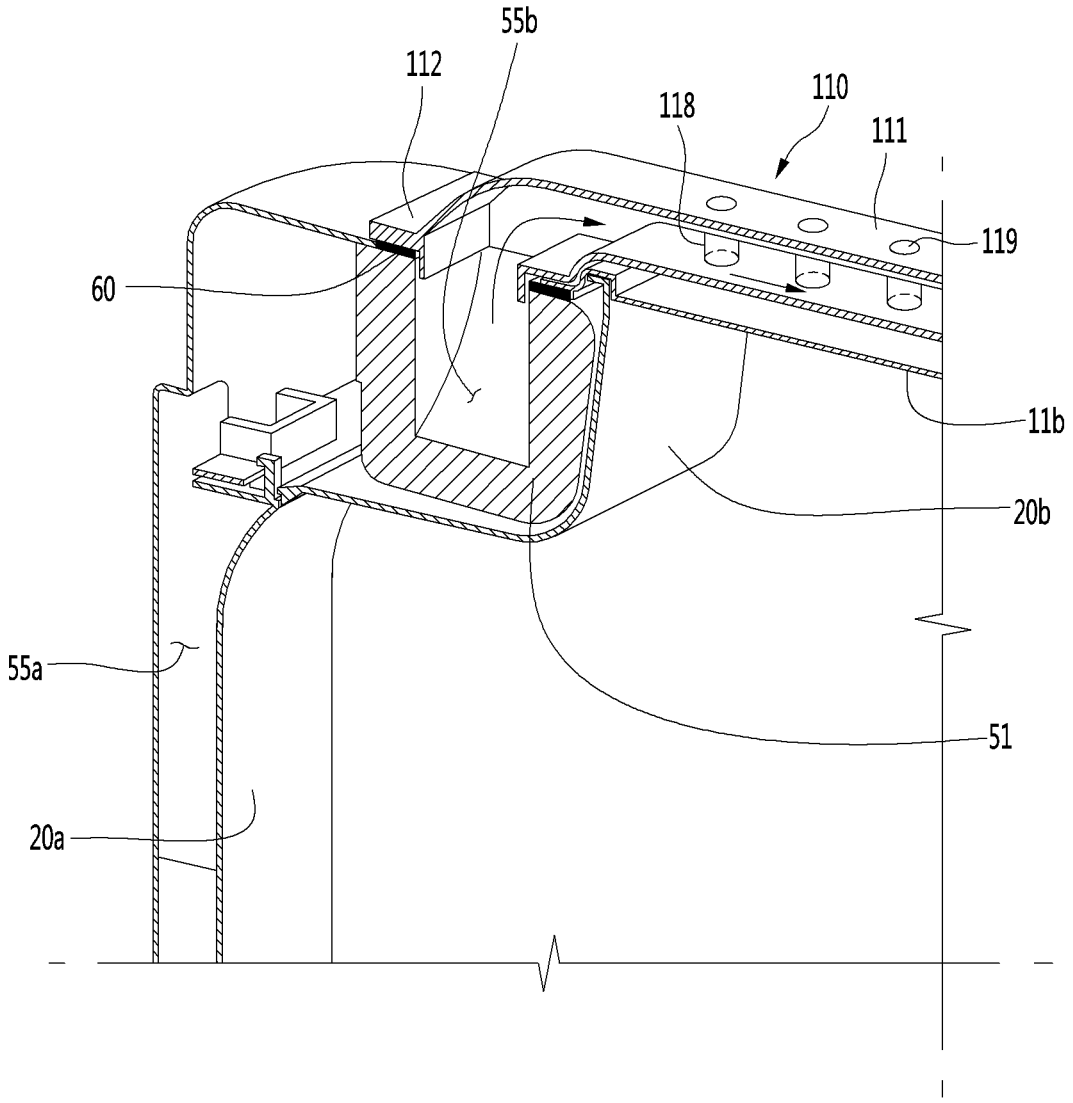
FIG. 6 is a sectional view taken along VI-VI' of FIG. 2.
Figure 7:
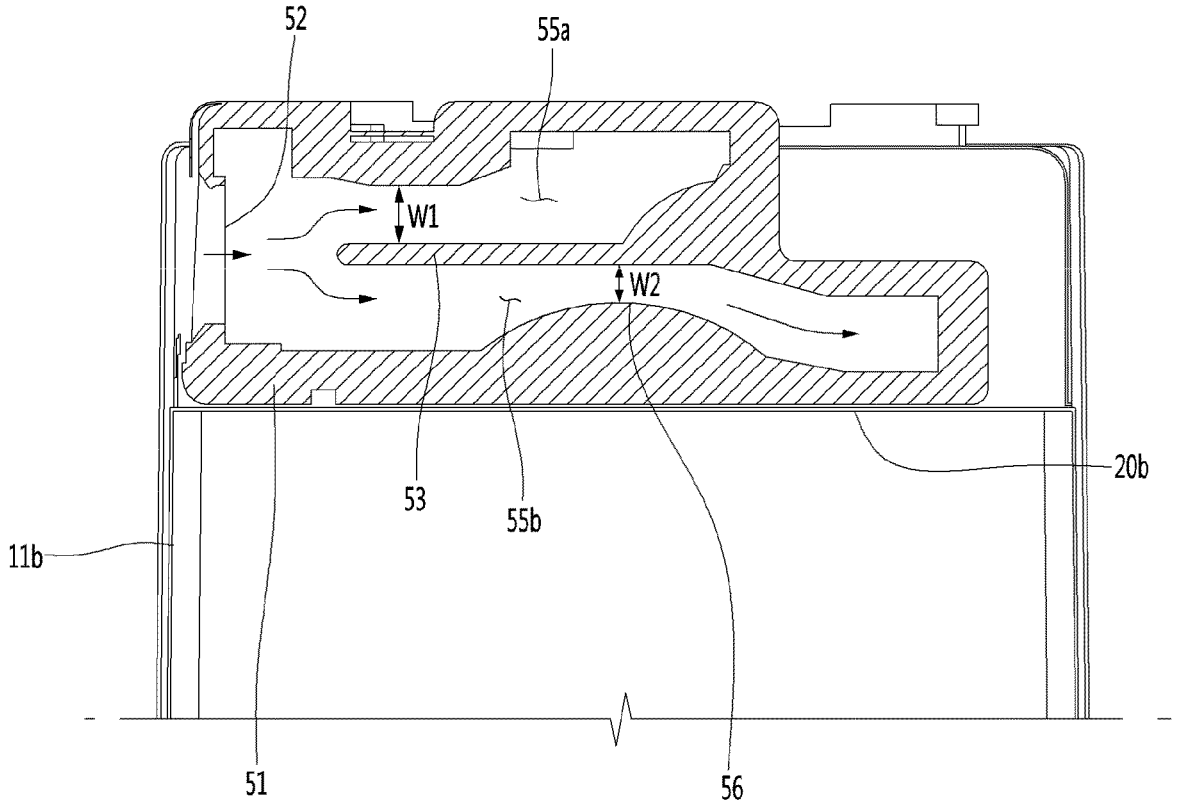
FIG. 7 is a sectional view taken along line VII-VII' of FIG. 3.

FIG. 4 is a view illustrating a configuration of an example control box and an example multi-duct, FIG. 5 is a sectional view taken along line V-V of FIG. 2, FIG. 6 is a sectional view taken along VI-VI' of FIG. 2, and FIG. 7 is a sectional view taken along line VII-VII' of FIG. 3.

Referring to FIGS. 4 to 7, in some implementations, the refrigerator 1 may include a control box 50 that has a box inlet portion 52 into which cool air flows through the connection flow path 36 and that is installed at the inner ceiling of the inner case 11*b*. The control box 50 may extend in a direction toward both left and right surfaces of the inner case 11*b*, that is, in the lateral direction.

The box inlet portion 52 may be defined on one side portion of the control box 50. Here, one side portion of the control box 50 may be a side portion facing the barrier 35. For example, the box inlet portion 52 may be defined on the right side portion of the control box 50.

The refrigerator 1 may include a multi-duct 20 that is disposed in the inner case 11*b* and that defines a plurality of first and second discharge holes 25 and 26 that are configured to discharge cool air into the refrigerating chamber 32. The multi-duct 20 includes a duct main body 20*a* disposed in front of a rear wall of the inner case 11*b* and a box cover portion 20*b* that extends forward from the upper side of the duct main body 20*a* and that covers a lower portion and front portion of the control box 50.

The plurality of first discharge holes 25 may be defined in the duct main body 20*a* and the plurality of second discharge holes 26 may be defined in the box cover portion 20*b*.

The duct assembly 100 includes a main duct 110 coupled to an upper surface of the control box 50. For example, the main duct 110 may be coupled to a point of an upper surface adjacent to a left side portion among the upper surface of the control box 50. In addition, a box discharge port 57*a* (see FIG. 9) for supplying the cool air of the control box 50 to the main duct 110 may be defined at the one point. In detail, the main duct 110 may include a box connection portion 112 coupled to the first box discharge port 57*a*.

Since the box inlet portion 52 is defined on the right side portion of the control box 50 and the box discharge port 57*a* is defined on a position adjacent to the left side portion of the control box 50, the cool air flowing into the control box 50 may flow in the left-right direction while passing the control box 50.

Cool air flow paths 55*a*, 55*b* are defined in the control box 50. In detail, the control box 50 includes a box main body 51 which has an approximately hexahedral shape and disposed at an upper portion of a rear wall of the refrigerating chamber 32 and a divider 53 which is disposed in the box main body 51 and partitions the cool air flow path 55*a* and 55*b*.

For example, the divider 53 may extend vertically from the upper surface of the box main body 51 toward the lower surface thereof. In addition, the divider 53 may extend in the lateral direction of the control box 50. Accordingly, the divider 53 may partition the cool air flow path defined inside the box main body 51 into a front flow path and a rear flow path.

The rear flow path includes a first flow path 55*a*. The first flow path 55*a* is defined in a space between the inner case 11*b* and the duct main body 20*a* and may vertically extend. The first flow path 55*a* may communicate with the first discharge hole 25 of the duct main body 20*a*.

The front flow path includes a second flow path 55*b*. The second flow path 55*b* is defined in the space between the divider 53 and the box cover portion 20*b* and may extend in the lateral direction. The second flow path 55*b* may communicate with the second discharge hole 26 of the box cover portion 20*b*.

The width of the second flow path 55*b* may be smaller than the width of the first flow path 55*a*. The "width" refers to a width in the front and rear direction. In addition, the width of the second flow path 55*b* is a width between the divider 53 and the front portion of the box main body 51 and the width of the first flow path 55*b* may mean the width between the divider 53 and the rear portions of the box main body 51.

In some cases, the width of the first flow path 55*a* or the width of the second flow path 55*b* may not be constant. However, the minimum width w2 of the width of the second flow path 55*b* may be smaller than the minimum width w1 of the width of the first flow path 55*a*.

A box protruding portion 56, which protrudes rearward, may be defined on the inner surface of the front portion of the box main body 51 to define the minimum width w2 of the second flow path 55*b*. The minimum width w2 may refer to a minimum distance between the divider 53 and the box protruding portion 56.

Since the width of the second flow path 55*b* is smaller than the width of the first flow path 55*a*, excess cool air may be prevented from flowing to the duct assembly 100 through the first flow path 55*a*. In a case where too much cool air flows into the duct assembly 100, the temperature of the other space of the refrigerating chamber 32 excluding the refrigerating chamber door 16 may become too high.

The second flow path 55*b* may communicate with the duct assembly 100. In detail, the cool air having flowed through the second flow path 55*b* may be discharged from the control box 50 and then flow to the front side of the refrigerating chamber 32 via the main duct 110. The main duct 110 includes a duct portion 111 which is coupled to an upper surface of the control box 50 to extend forward. The duct portion 111 may be positioned above the upper surface of the inner case 11*b*.

The control box 50 may be referred to as "a cool air distribution device" in that the control box 50 defines first and second flow paths 55*a* and 55*b* and is configured to distribute cool air to be supplied to the refrigerating chamber 32.

The cool air flow in the control box 50 will be briefly described.

The cool air transferred from the freezing chamber 31 flows into the control box 50 through the box inlet portion 52 and the cool air flow path is partitioned into a first flow path 55*a* and a second flow path 55*b*. The cool air of the first flow path 55*a* flows downward from the rear portion of the control box 50 and may flow into the refrigerating chamber 32 through the first discharge hole 25 of the multi-duct 20.

In addition, the cool air flows sideways from the front portion of the control box 50 of the second flow path 55*b*, a portion of the cool air may be discharged to the upper portion of the refrigerating chamber 32 through the second discharge hole 26, and another portion of the cool air may be discharged to the duct assembly 100 through the first box discharge port 57*a*.

Figure 8:
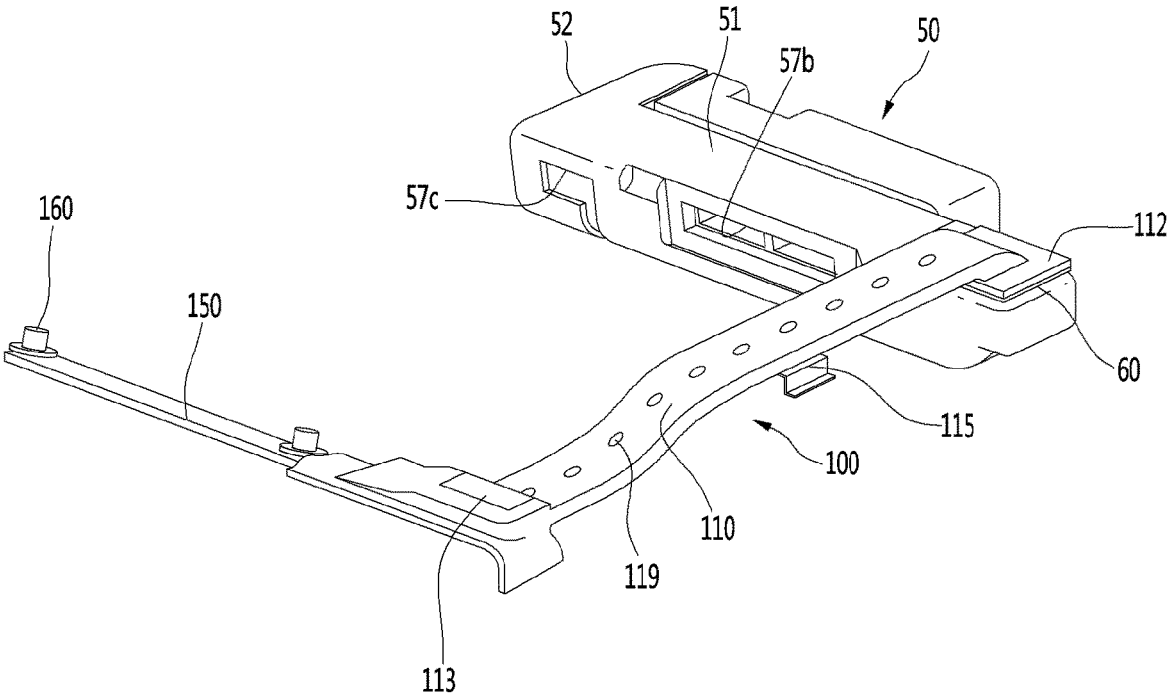
FIG. 8 is a view illustrating a coupled state of an example control box and an example duct assembly.
Figure 9:
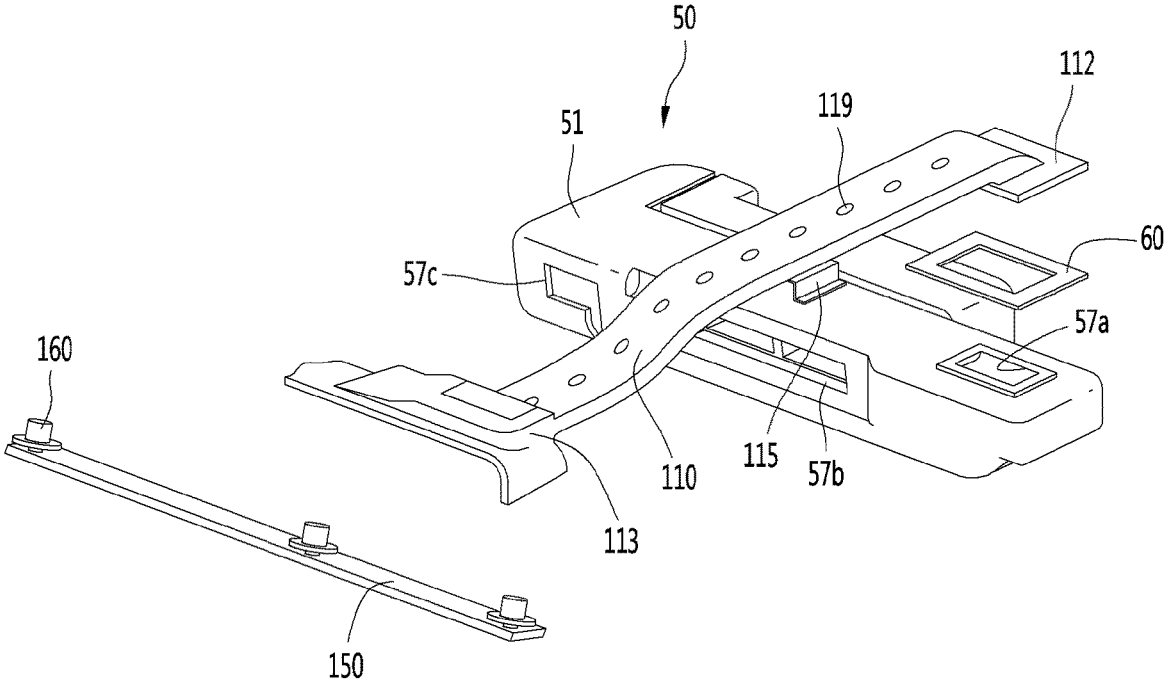
FIG. 9 is an exploded view illustrating a configuration of an example control box and an example duct assembly.
Figure 10:
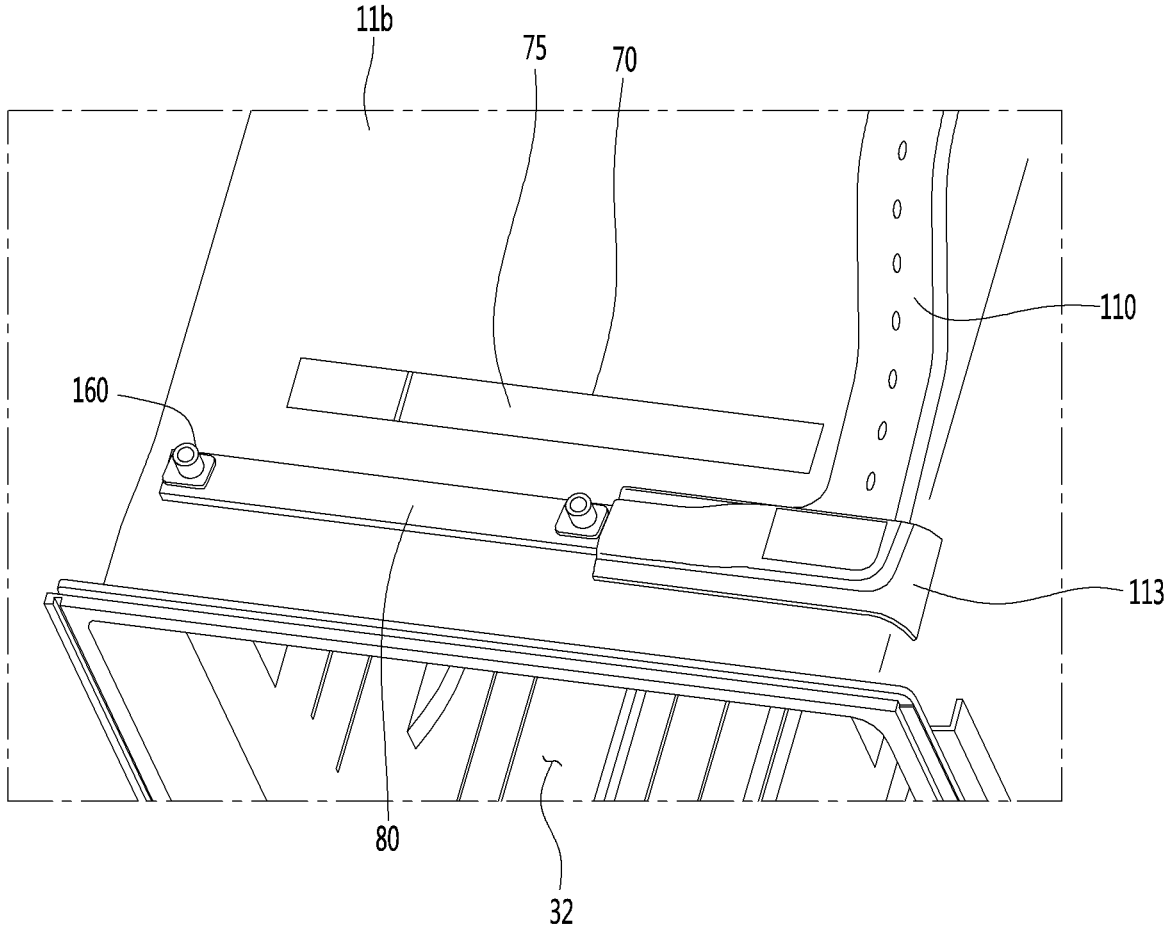
FIG. 10 is a view illustrating an example duct assembly coupled to an upper surface of an example inner case.
Figure 11:
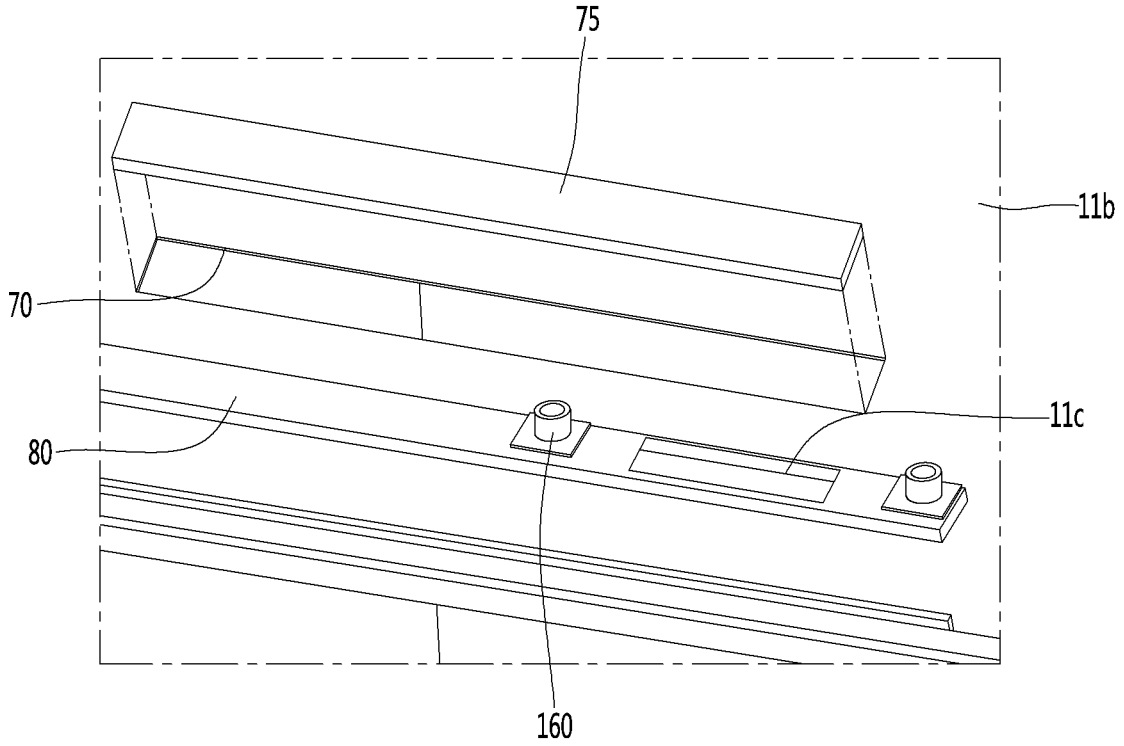
FIG. 11 is a view illustrating an upper surface configuration of an example inner case.
Figure 12:
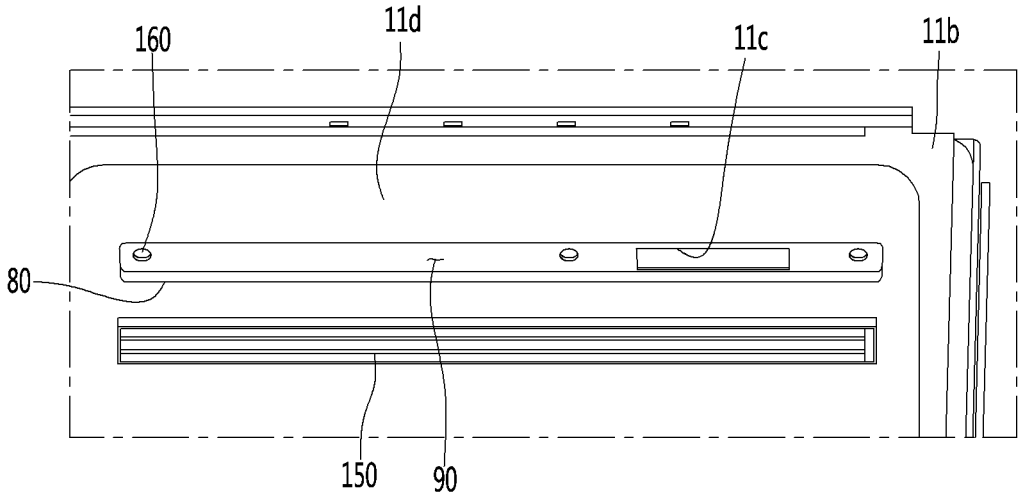
FIG. 12 is a view illustrating the upper inner surface of the inner case of FIG. 11.
Figure 13:
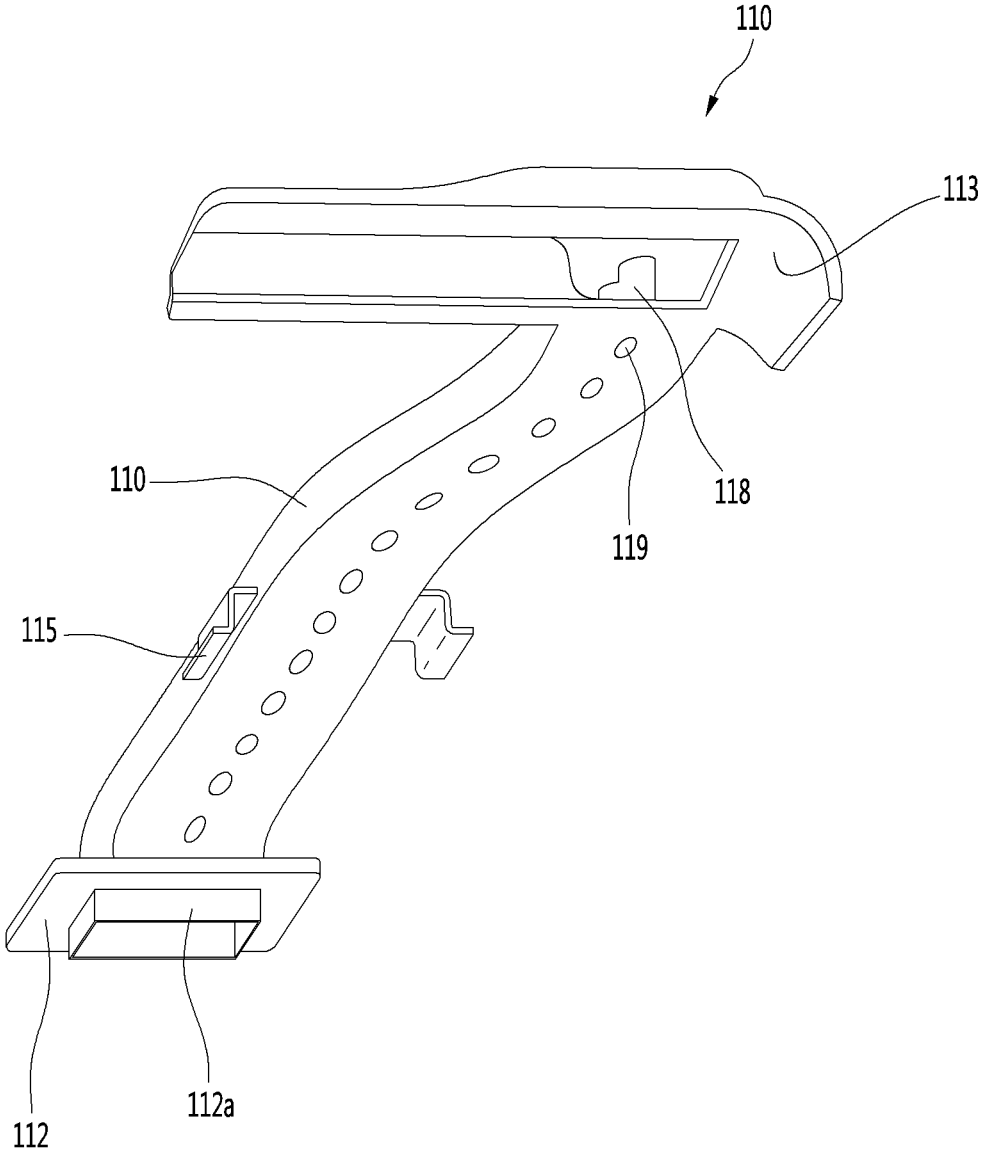
FIG. 13 is a bottom perspective view illustrating a configuration of an example main duct.

FIG. 8 is a view illustrating a coupled state of an example control box and a duct assembly, and FIG. 9 is an exploded view illustrating a configuration of an example control box and an example duct assembly.

Referring to FIGS. 8 and 9, the refrigerator 1 may include a duct assembly 100 that is configured to guide the flow of cool air and that is coupled to the control box 50 so as to transfer cool air to the side of the refrigerating chamber door 16.

The control box 50 may include a plurality of box discharge ports 57*a*, 57*b*, and 57*c* for discharging cool air flowing into the control box 50 through the box inlet portion 52.

The plurality of box discharge ports 57*a*, 57*b*, and 57*c* includes a first box discharge port 57*a* communicating with the duct assembly 100. The first box discharge port 57*a* may be defined as an opening on the upper surface of the box main body 51. For example, the first box discharge port 57*a* is defined on the upper surface of the left side portion of the box main body 51.

The plurality of box discharge ports 57*a*, 57*b*, and 57*c* further include a second box discharge port 57*b* and a third box discharge port 57*c* communicating with the second discharge holes 26 of the multi-duct 20. The second box discharge port 57*b* may be defined on a front right portion of the box main body 51 and the third box discharge port 57*c* may be defined on a front central portion of the box main body 51.

The cool air discharged through the second and third box discharge ports 57*b* and 57*c* may be discharged to the upper portion of the refrigerating chamber 32 through the plurality of second discharge holes 26.

The refrigerator 1 further includes a sealing member 60 coupled to the first box discharge port 57*a*. The sealing member 60 has a hollow plate shape and may be placed on the upper side of the first box discharge port 57*a*. The sealing member 60 may prevent the leakage of cool air between the control box 50 and the duct assembly 100.

The duct assembly 100 includes a main duct 110 that extend forward from the first box discharge port 57*a* and positioned above the inner case 11*b*. For example, the main duct 110 may extend toward the refrigerating chamber door 16. In some examples, the main duct 110 may include a pipe-shaped duct portion 111 and a box connection portion 112 disposed at a rear portion of the duct portion 111 and coupled to the upper side of the sealing member 60. The box connection portion 112 may cover the sealing member 60 and guide the cool air discharged from the first box discharge port 57*a* into the main duct 110.

In some implementations, the duct assembly 100 may further include a discharge port inserting portion 112*a* that protrudes downward from the box connection portion 112 and that is configured to insert into the first box discharge port 57*a*. The discharge port inserting portion 112*a* may have a hollow pipe shape.

At the side of the duct portion 111, a case fastening portion 115 coupled to the inner case 11*b* is provided. The case fastening portion 115 may be provided on both sides of the duct portion 111 and may be coupled to the center portion of the upper surface of the inner case 11*b*.

The duct portion 111 includes a case connection portion 113 coupled to a front portion of the upper surface of the inner case 11*b* in the front portion thereof. The case connection portion 113 may cover the case inlet portion 11*c* of the inner case 11*b*.

The case inlet portion 11*c* may be understood as a configuration for guiding cool air having flowed through the main duct 110 into the front portion of the refrigerating chamber 32. The case inlet portion 11*c* may be defined to penetrate at least a portion of the upper surface of the inner case 11*b*.

The duct assembly 100 further includes a discharge grill 150 coupled to a lower side of the case connection portion 113. The discharge grill 150 has a bar shape extending in the lateral direction and may be coupled to the inside of the upper portion of the inner case 11*b*. The discharge grill 150 may be defined with a discharge hole for discharging cool air.

The discharge grill 150 may be coupled to the inner case 11*b* by a fastening portion 160. A plurality of fastening portion 160 may be provided and the plurality of fastening portion 160 may be spaced apart from each other in the lateral direction and may be coupled to the discharge grill 150 and the inner case 11*b*.

The inner case 11*b* includes a recessed portion 80 configured to guide the cool air flowing into the refrigerating chamber 32 through the case inlet portion 11*c* in the lateral direction. A case flow path 90 as a cool air flow path may be defined in the recessed portion 80.

The recessed portion 80 may have a shape recessed upward when viewed from the inside of the refrigerating chamber 32. In other words, the recessed portion 80 is configured such that the inner side portion of the upper surface 11*d* of the inner case 11*b* is recessed upward. Therefore, when being viewed from the outer side of the inner case 11*b*, the recessed portion 80 may be seen to protrude upward from the upper surface of the inner case 11*b*.

The recessed portion 80 is defined in the inner case 11*b* to form a cool air flow path, so that the food storage space of the refrigerating chamber 32 may not be reduced.

The case inlet portion 11*c* may be defined on the left side portion of the recessed portion 80. Therefore, the cool air which has flowed toward a side of the recessed portion 80 through the case inlet portion 11*c* may flow in the right direction, and may be discharged to the upper space of the refrigerating chamber 32, that is, the upper side space of the refrigerating chamber door 16 through the discharge grill 150.

In some implementations, the refrigerator 1 may include an illumination source 75 that is configured to irradiate light to the refrigerating chamber 32 and that is installed on the upper surface of the inner case 11*b*. In some examples, to install the illumination source 75, an illumination source coupling unit 70 may be defined on the upper surface of the inner case 11*b*. The illumination source coupling unit 70 may be defined by opening at least a portion of the upper surface of the inner case 11*b* and may be positioned on the rear side of the recessed portion 80.

The illumination source 75 may include a surface light LED which is capable of uniformly irradiating light to a predetermined area.

The main duct 110 further includes a duct support 118 for preventing the main duct 110 from being compressed or damaged. The duct support 118 vertically extends inside the duct portion 111 and may extend from the inner lower surface to the inner upper surface of the duct portion 111.

In a state where the outer case 11*a* and the inner case 11*b* are assembled and the duct assembly 100 is installed in the inner case 11*b*, the foaming step of the foaming liquid for forming a heat-insulating material may be performed between the outer case 11*a* and the inner case 11*b*.

In this process, it may be necessary to reinforce the strength of the main duct 110 to prevent the duct assembly 100 from being damaged by the internal pressure due to the spraying of the foamed liquid. The duct support 118 reinforces the strength of the main duct 110.

The duct support 118 may be defined by punching the lower surface of the main duct 110 upward. In detail, when the lower and upper surfaces of the main duct 110 are punched, the lower surface of the main duct 110 is recessed upward and the upper surface of the main duct 110 is recessed downward to have a duct recessed portion 119. In addition, the duct recessed portion 119 may form the duct support 118 in the duct portion 111. A plurality of duct supports 118 may be spaced apart from each other in the front and rear direction in which the duct portion 111 extends.

Referring to FIG. 2 and FIGS. 4 to 7, the cool air flow will be described.

The cool air in the freezing chamber 31 flows into the box inlet portion 52 of the control box 50 through the connection flow path 36 of the barrier 35. The cool air flowing into the control box 50 is branched by the divider 53 and branched into the first flow path 55*a* and the second flow path 55*b*.

The cool air flowing through the first flow path 55*a* is discharged to the refrigerating chamber 32 through the first discharge hole 25 of the duct main body 20*a* and the cool air flowing through the second flow path 55*b* may be discharged to the upper portion of the refrigerating chamber 32 through the second discharge hole 26 of the box cover portion 20*b*.

Some of the cool air flowing through the second flow path 55*b* may flow to the duct assembly 100 and be supplied to the front side of the refrigerating chamber 32. In other words, since the cool air of the duct assembly 100 may be supplied to a side of the refrigerating chamber door 16 provided on the front side of the refrigerating chamber 32, the cooling performance of the object to be stored which is stored in the refrigerating chamber door 16 may be improved.

What is claimed is:

1. A refrigerator comprising:

an inner case that defines a storage chamber, the inner case including a bottom wall, side walls, a rear wall, and a top wall;

a door disposed at a front portion of the inner case, the door defining a storage space therein;

a cool air distribution device that is disposed inside the inner case and that defines a box inlet portion configured to receive cool air, the cool air distribution device being located vertically below the top wall of the inner case;

a multi-duct that is disposed in the inner case and that defines a plurality of discharge holes configured to discharge a first portion of cool air in the cool air distribution device to the storage chamber; and a duct assembly that is coupled to the cool air distribution device, that extends toward the door, and that is configured to carry a second portion of cool air in the cool air distribution device, wherein the top wall of the inner case defines a case inlet at the front portion of the inner case, the case inlet including a hole that passes through a portion of the inner case and is configured to supply the second portion of cool air to the storage chamber, wherein the duct assembly comprises a duct portion provided on the top wall of the inner case, and a case connection portion that is provided at a front portion of the duct portion and disposed vertically above the hole, wherein the inner case further comprises a recessed portion recessed upwardly from an inner upper surface of the inner case, and wherein the case inlet is defined in the recessed portion.

2. The refrigerator according to claim 1, wherein the multi-duct is disposed at the rear wall of the inner case, and wherein the cool air distribution device comprises a box disposed between the rear wall of the inner case and the multi-duct.

3. The refrigerator according to claim 1, wherein the storage chamber comprises a freezing chamber and a refrigerating chamber that are disposed in a lateral direction, wherein the inner case comprises a first inner case that defines the refrigerating chamber and a second inner case that defines the freezing chamber, and wherein the refrigerator further comprises a barrier that defines a connection flow path between the first inner case and the second inner case.

4. The refrigerator according to claim 3, wherein the box inlet portion faces the barrier, and is configured to communicate with the connection flow path and to receive cool air in the freezing chamber.

5. The refrigerator according to claim 1, wherein the cool air distribution device comprises:

a box main body that defines a cool air flow path; and a divider that is disposed inside the box main body and that partitions the cool air flow path.

6. The refrigerator according to claim 5, wherein the divider extends vertically at an inside of the box main body and partitions the cool air flow path into a first flow path and a second flow path.

7. The refrigerator according to claim 6, wherein the plurality of discharge holes of the multi-duct comprise:

a first discharge hole configured to communicate with the first flow path; and a second discharge hole configured to communicate with the second flow path.

8. The refrigerator according to claim 6, wherein the first flow path is disposed between the rear wall of the inner case and the multi-duct, and wherein the second flow path is disposed between the divider and a front portion of the box main body.

9. The refrigerator according to claim 6, wherein the box main body defines a box discharge port configured to communicate with the second flow path and to supply cool air to the duct assembly.

10. The refrigerator according to claim 1, wherein the duct assembly is disposed at an upper side of the top wall of the inner case.

11. The refrigerator according to claim 1, further comprising:

a discharge grill coupled to the recessed portion and configured to discharge cool air toward the storage space of the door.

12. The refrigerator according to claim 1, further comprising a cabinet including the inner case and an outer case, the outer case being disposed outside the inner case and defining an outer appearance of the cabinet, wherein the duct portion is located in a space between the outer case and the top wall of the inner case.

13. A refrigerator comprising:

an inner case that defines a storage chamber;

a door disposed at a front portion of the inner case, the door defining a storage space therein;

a cool air distribution device that is disposed inside the inner case and that defines a box inlet portion configured to receive cool air, the cool air distribution device comprising a box main body that defines a cool air flow path and a divider that is disposed inside the box main body and partitions the cool air flow path into a first flow path and a second flow path;

a multi-duct that is disposed in the inner case, the multi-duct comprising (i) a duct body provided at a front side of a rear wall of the inner case and (ii) a box cover portion that covers at least a portion of the box main body, wherein at least a portion of the first flow path is defined by a space defined between the duct body and the rear wall of the inner case; and a duct assembly that is coupled to the cool air distribution device, the duct assembly being be fluidly connected to the second flow path and separated from the first flow path, wherein the duct assembly comprises a duct portion that is coupled to an opened end of the second flow path and extends from the opened end of the second flow path toward the door, wherein the multi-duct comprises:

a first discharge hole defined in the duct body and fluidly connected to the first flow path, the first discharge hole being configured to discharge a first portion of cool air in the cool air distribution device to the storage chamber, and a second discharge hole defined in the box cover portion and fluidly connected to the second flow path, the second discharge hole being configured to discharge a second portion of cool air in the cool air distribution device to the storage chamber, and wherein the inner case defines a case inlet at the front portion of the inner case, the case inlet being fluidly connected to the duct portion and configured to supply a third portion of cool air in the cool air distribution device to the storage chamber.

14. The refrigerator according to claim 13, wherein the case inlet is disposed vertically above the storage space.

15. The refrigerator according to claim 13, wherein the duct assembly is disposed on a top wall of the inner case.

16. The refrigerator according to claim 13, wherein the duct portion is coupled to an upper surface of the box main body and extends forward, and wherein the duct assembly further comprises a case connection portion disposed at a front portion of the duct portion and coupled to the case inlet.

17. A refrigerator comprising:

an inner case that defines a storage chamber comprising a freezing chamber and a refrigerating chamber, the inner case comprising a first inner case that defines the refrigerating chamber and a second inner case that defines the freezing chamber;

a barrier that defines a connection flow path between the first inner case and the second inner case, the connection flow path being configured to allow flow of cool air;

a door disposed at a front portion of the first inner case, the door defining a storage space therein;

a cool air distribution device that is disposed inside the first inner case and that defines a box inlet portion configured to receive cool air in the connection flow path;

a multi-duct that is disposed in the first inner case and that defines a plurality of discharge holes configured to discharge a first portion of cool air in the cool air distribution device to the storage chamber; and a duct assembly that is coupled to the cool air distribution device, that extends toward the door, and that is configured to carry a second portion of cool air in the cool air distribution device, wherein the first inner case comprises a bottom wall, side walls, a rear wall, and a top wall, wherein the first inner case defines a recessed portion that is recessed from an inner surface of the top wall and a case inlet that is disposed at the recessed portion the case inlet being configured to communicate with the duct assembly and to supply the second portion of cool air to the storage chamber, wherein the duct assembly comprises a case connection portion that is disposed at an outer surface of the top wall and covers the case inlet, and wherein the refrigerator further comprises a discharge grille provided at the recessed portion and configured to discharge cool air toward the storage space of the door.

18. The refrigerator according to claim 17, wherein the first inner case and the second inner case are horizontally arranged and face each other, and wherein the second inner case faces the one of the side walls of the first inner case.

19. The refrigerator according to claim 17, wherein the case connection portion covers at least a portion of the discharge grille.

20. A refrigerator comprising:

an inner case that defines a storage chamber;

a door disposed at a front portion of the inner case, the door defining a storage space therein;

a cool air distribution device that is disposed inside the inner case and that defines a box inlet portion configured to receive cool air;

a multi-duct that is disposed in the inner case and that defines a plurality of discharge holes configured to discharge a first portion of cool air in the cool air distribution device to the storage chamber; and a duct assembly that is coupled to the cool air distribution device, that extends toward the door, and that is configured to carry a second portion of cool air in the cool air distribution device, wherein the inner case defines a case inlet that is disposed at the front portion of the inner case, that is configured to communicate with the duct assembly, and that is configured to supply the second portion of cool air to the storage chamber, and wherein the duct assembly comprises a duct portion, the duct portion comprising a duct support that is disposed inside the duct portion and that extends upward from a lower surface of the duct portion to an upper surface of the duct portion.

* * * * *